US009016836B2

(12) United States Patent
Kunnavakkam et al.

(10) Patent No.: US 9,016,836 B2
(45) Date of Patent: Apr. 28, 2015

(54) INK JET PRINTHEAD WITH POLARITY-CHANGING DRIVER FOR THERMAL RESISTORS

(71) Applicants: STMicroelectronics Asia Pacific Pte. Ltd., Singapore (SG); STMicroelectronics, Inc., Coppell, TX (US); STMicroelectronics Pte. Ltd., Singapore (SG)

(72) Inventors: Madanagopal Kunnavakkam, Singapore (SG); Jin Zhi Li, Singapore (SG); Teck Khim Neo, Singapore (SG); Kenneth W. Smiley, Carrollton, TX (US); Chun Chek Bong, Singapore (SG)

(73) Assignees: STMicroelectronics, Inc., Coppell, TX (US); STMicroelectronics Asia Pacific Pte. Ltd., Singapore (SG); STMicroelectronics Pte Ltd, Singapore (SG)

( * ) Notice: Subject to any disclaimer, the term of this patent is extended or adjusted under 35 U.S.C. 154(b) by 0 days.

(21) Appl. No.: 13/893,472

(22) Filed: May 14, 2013

(65) Prior Publication Data

US 2014/0340452 A1 Nov. 20, 2014

(51) Int. Cl.
*B41J 2/05* (2006.01)
*B41J 2/14* (2006.01)

(52) U.S. Cl.
CPC ..... *B41J 2/14129* (2013.01); *B41J 2/14072* (2013.01); *B41J 2002/14387* (2013.01)

(58) Field of Classification Search
None
See application file for complete search history.

(56) References Cited

U.S. PATENT DOCUMENTS

| | | | |
|---|---|---|---|
| 6,204,182 | B1 | 3/2001 | Truninger et al. |
| 6,331,868 | B1 | 12/2001 | Yamade et al. |
| 6,422,688 | B2 | 7/2002 | Giere et al. |
| 6,454,955 | B1 | 9/2002 | Beerling et al. |
| 6,517,735 | B2 | 2/2003 | Trueba et al. |
| 6,565,176 | B2 | 5/2003 | Anderson et al. |
| 6,622,373 | B1 | 9/2003 | Tu |
| 6,905,620 | B2 | 6/2005 | Silverbrook |
| 6,926,386 | B2 | 8/2005 | Shin et al. |
| 6,945,634 | B2 | 9/2005 | Pugliese, Jr. et al. |
| 7,014,785 | B2 | 3/2006 | Silverbrook |
| 7,048,868 | B2 | 5/2006 | Silverbrook |
| 7,306,309 | B2 | 12/2007 | Kuwahara et al. |
| 7,470,001 | B2 | 12/2008 | Kim et al. |

(Continued)

FOREIGN PATENT DOCUMENTS

EP 0 709 198 B1 11/1999

OTHER PUBLICATIONS

Lim et al., "Investigation of Reliability Problems in Thermal Inkjet Printhead," IEEE, 42nd Annual International Reliability Physics Symposium, Phoenix, 2004, pp. 251-254.

(Continued)

*Primary Examiner* — Matthew Luu
*Assistant Examiner* — Erica Lin
(74) *Attorney, Agent, or Firm* — Allen, Dyer, Doppelt, Milbrath & Gilchrist, P.A.

(57) ABSTRACT

An ink jet printhead device includes a substrate and a plurality of thermal resistors on the substrate. Each thermal resistor includes first and second electrodes and a resistive layer extending therebetween. A polarity-changing driver is coupled to the plurality of thermal resistors and configured to change a driving polarity between the first and second electrodes of each of the plurality of thermal resistors.

10 Claims, 8 Drawing Sheets

(56) References Cited

U.S. PATENT DOCUMENTS

| | | | | |
|---|---|---|---|---|
| 7,479,180 | B2 | 1/2009 | Vasudevan | |
| 7,790,635 | B2 | 9/2010 | Balseanu et al. | |
| 7,833,830 | B2 | 11/2010 | Chen et al. | |
| 8,334,219 | B2 | 12/2012 | Lee et al. | |
| 2002/0129495 | A1* | 9/2002 | Trueba et al. | 29/890.01 |
| 2003/0189241 | A1 | 10/2003 | Kamada et al. | |
| 2005/0225576 | A1* | 10/2005 | Shoji | 347/5 |
| 2006/0125879 | A1 | 6/2006 | Fujii et al. | |
| 2012/0293587 | A1 | 11/2012 | Bakker et al. | |
| 2012/0299186 | A1 | 11/2012 | White et al. | |

OTHER PUBLICATIONS

Yuan et al., "Acceleration of Dielectric Charging in RF MEMS Capacitive Switches," IEEE, Transactions on Device and Materials Reliability, vol. 6, No. 4, Dec. 2006, pp. 556-563.

Tao et al., "An Electromigration Failure Model for Interconnects Under Pulsed and Bidirectional Current Stressing," IEEE, Transactions on Electron Devices, vol. 41, No. 4, Apr. 1994, pp. 539-545.

* cited by examiner

| | | STRESS IN E2 Mpa | |
|---|---|---|---|
| | Ta | SiC | SiN |
| HIGH COMPRESSIVE | -0.8905 | -6.622 | -5.113 |
| | | | |
| NORMAL | -4.342 | -5.562 | -3.392 |
| | | | |
| LOW COMPRESSIVE | -10.2 | -2.742 | -2.083 |

FIG. 9A

| | | STRESS IN E2 Mpa | |
|---|---|---|---|
| | Ta | SiC | SiN |
| | | | |
| HIGH COMPRESSIVE | -1.2 | -6.702 | -5.047 |
| NORMAL | -4.8 | -5.531 | -3.302 |
| LOW COMPRESSIVE | -9.75 | -2.763 | -2.11 |

FIG. 9B

| | STRESS IN E2 Mpa | |
|---|---|---|
| | SiC | SiN |
| HIGH COMPRESSIVE | -6.878 | -5.126 |
| | | |
| NORMAL | -5.266 | -2 |
| | | |
| LOW COMPRESSIVE | -2.593 | -3.391 |

FIG. 9C

INK JET PRINTHEAD WITH POLARITY-CHANGING DRIVER FOR THERMAL RESISTORS

FIELD OF THE INVENTION

This invention relates to ink jet printing, and more particularly, this invention relates to ink jet printhead devices that include a plurality of thermal resistors that vaporizes and ejects ink from an ink jet nozzle.

BACKGROUND OF THE INVENTION

Modern ink jet printers may produce photographic-quality images. A thermal ink jet printer includes a number of nozzles spatially positioned in a printer cartridge. Ink is heated when an electrical pulse energizes the resistive element forming the thermal resistor. The ink resting above the thermal resistor is ejected through the nozzle towards a printing medium, such as an underlying sheet of paper as a result of the applied electrical pulse.

This thermal resistor is formed as a thin film resistive material disposed on a semiconductor substrate and a dielectric layer as part of a semiconductor chip. Several thin film layers are formed on the semiconductor chip, including the dielectric layer above the substrate, the resistive layer forming the thermal resistor above the dielectric layer, and an electrode layer that defines the electrodes coupled to the resistive layer to which the pulse is applied to heat the thermal resistor and vaporize the ink. At least one dielectric layer, and a protection layer are typically above the electrode layer. The protection layer protects the resistive layer and other layers from oxidation and chemical degradation caused by the ink as it is heated and ejected from the nozzle. Example dielectric layers include silicon nitride and silicon carbide layers.

Many thermal ink jet printheads use a tantalum/aluminum (TaAl) (various other resistor materials are possible like tantalum silicon nitride (TaSiN)) thin film as the resistive layer. Over time, this TaAl layer may degrade as numerous electrical pulses are applied during printing. It has been found that these thermal resistors often start failing at the grounded edge due to voids induced by electromigration. Also, the gradual electric charging of the dielectric layers over the electrode and thermal resistors may lead to potential build up sufficient to discharge the charges by arcing to ground and result in rupture of the resistors. It has also been observed that some thermal resistors had different failure lifetimes depending on the configuration of the electrode layer relative to the thermal resistor, and the amount of compressive or tensile forces applied by the dielectric layers over the electrode layer.

SUMMARY OF THE INVENTION

An ink jet printhead device may include a substrate and a plurality of thermal resistors on the substrate. Each thermal resistor includes first and second electrodes and a resistive layer extending therebetween. A polarity-changing driver is coupled to the plurality of thermal resistors and configured to change a driving polarity between the first and second electrodes of each of the plurality of thermal resistors.

In one example, the polarity-changing driver is configured to periodically reverse a driving voltage polarity. The polarity-changing driver may be configured to generate a series of pulse trains and perform as a counter configured to reverse the polarity based upon a count of the series of pulse trains. In another example, the polarity-changing driver is configured to generate the series of pulse trains in alternating polarity.

The polarity-changing driver may be configured to change a voltage polarity so that the first electrode is at a voltage reference at a first polarity and the second electrode is at a voltage reference at a second polarity.

The polarity-changing driver comprises an H-bridge that is on the substrate (or on another chip also) in another example. Each of the first and second electrodes comprise at least one of copper and aluminum. The resistive layer comprises at least one of tantalum and aluminum.

A method of ink jet printing using an ink jet printhead device includes a substrate, and a plurality of thermal resistors on the substrate. Each thermal resistor may comprise first and second electrodes and a resistive layer extending therebetween. The method comprises changing a driving polarity between the first and second electrodes of each of the plurality of thermal resistors.

BRIEF DESCRIPTION OF THE DRAWINGS

Other objects, features and advantages of the present invention will become apparent from the detailed description of the invention which follows, when considered in light of the accompanying drawings in which:

FIGS. 9A-9C are tables showing values of tested examples of high and low dielectric stress for dielectric films.

DETAILED DESCRIPTION OF THE PREFERRED EMBODIMENTS

Different embodiments will now be described more fully hereinafter with reference to the accompanying drawings, in which preferred embodiments are shown. Many different forms can be set forth and described embodiments should not be construed as limited to the embodiments set forth herein. Rather, these embodiments are provided so that this disclosure will be thorough and complete, and will fully convey the scope to those skilled in the art.

Figure 1:
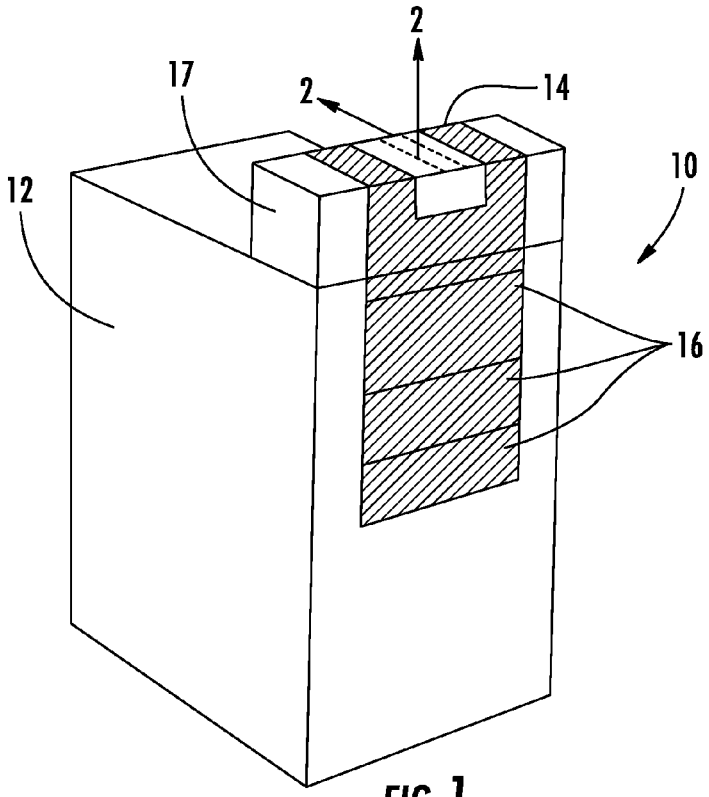
FIG. 1 is a perspective view of an ink jet printhead cartridge that incorporates an ink jet printhead device in accordance with a non-limiting example.

FIG. 1 is a perspective view of an ink jet printhead cartridge 10 in accordance with a non-limiting example. This ink jet print cartridge 10 includes a cartridge body 12 that contains ink for an ink jet printhead. As explained below, the ink is channeled into a plurality of ink ejection chambers, each associated with a respective printhead nozzle 14 positioned on the body 12 and configured to eject ink onto the paper or other print media. Electrical signals are provided traces 16 to energize thermal resistors that heat the ink and eject a droplet of ink through an associated nozzle 14.

Figure 2:
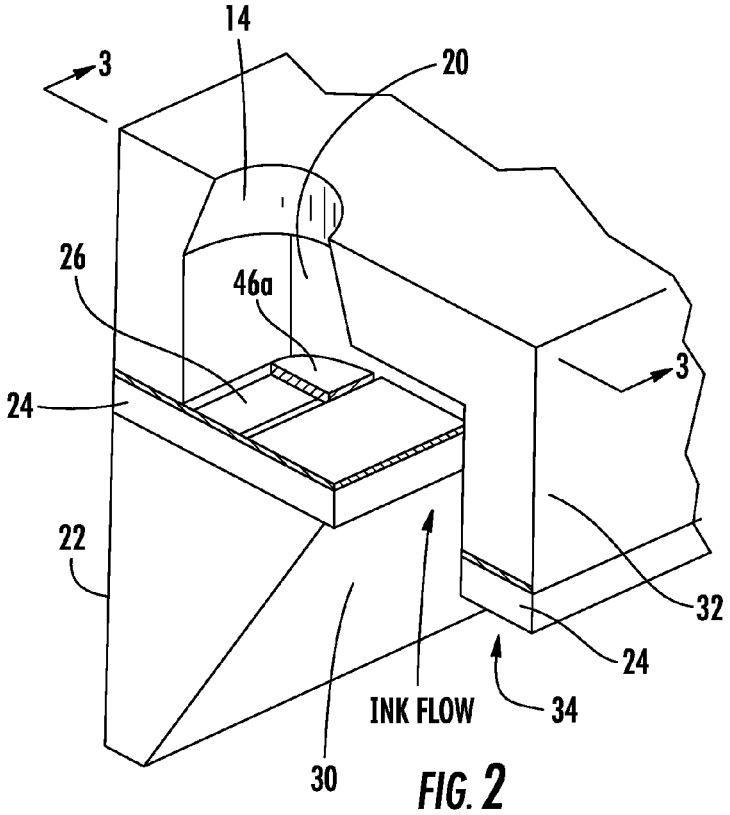
FIG. 2 is a perspective cut-away view taken generally along line 2-2 of a portion of the ink jet printhead device in FIG. 1 and showing the thermal resistor and nozzle in accordance with a non-limiting example.
Figure 3:
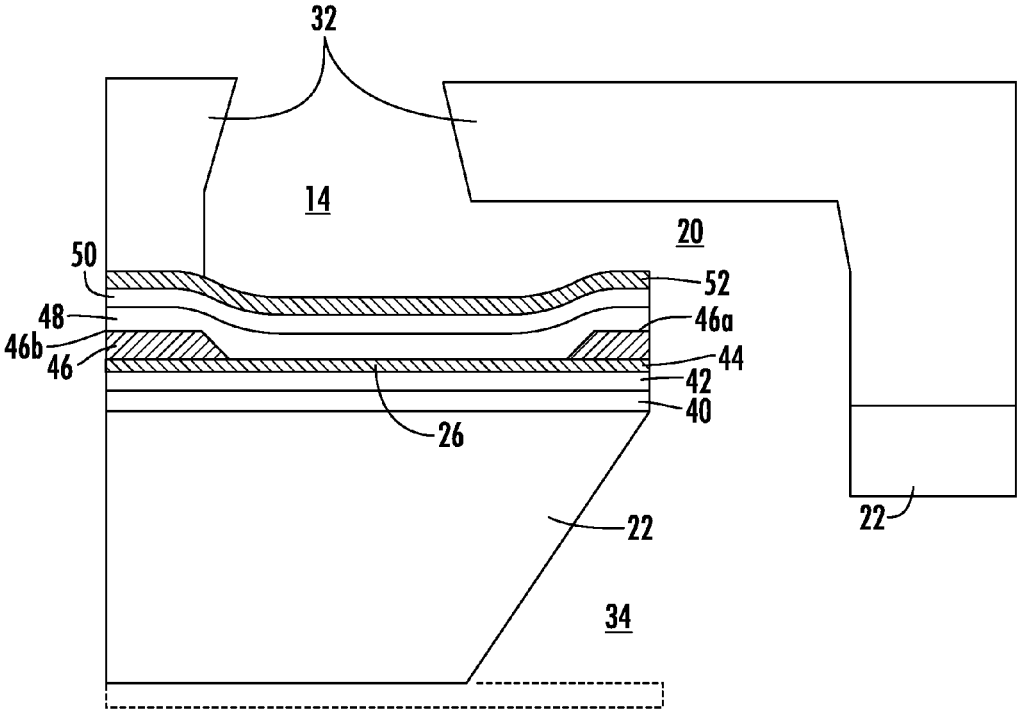
FIG. 3 is a cross-sectional view taken along line 3-3 of FIG. 2 and showing dielectric layers that can have a compressive stress magnitude to extend the lifetime of the thermal resistor in accordance with a non-limiting example.

The print cartridge 10 shown in FIG. 1 includes the plurality of nozzles 14 disposed at the printhead cartridge 10 at an ink jet printhead 17 of the printhead cartridge. In an example, the printhead cartridge 10 may include 300 or more nozzles 14, each nozzle 14 having an associated ink ejection chamber 20 as explained below with reference to FIGS. 2 and 3. In the description of FIGS. 2 and 3 that follows, only one ink ejection chamber is described relative to a single nozzle 14.

FIG. 2 is a cross-sectional view of a portion of the ink jet printhead 17 of FIG. 1 and showing a single nozzle 14 in partial cut-away that is representative of the hundreds of nozzles 14 that are disposed on the printhead cartridge 10 of FIG. 1. Each nozzle 14 includes a single ink ejection chamber 20 associated with a respective nozzle 14. Only one nozzle 14 and ink ejection chamber 20 is described since the same functional description applies to all of the different nozzles and ink ejection chambers. During manufacture, many printheads 17 may be formed on a single silicon wafer and separated from each other using conventional semiconductor processing techniques as known to those skilled in the art.

FIG. 2 shows the nozzle 14 in partial cut-away sectional view taken along line 2-2 of FIG. 1 and formed on a silicon substrate 22 that includes various thin film layers indicated generally at 24 as described in greater detail relative to FIG. 3. One of the thin film layers 24 is a resistive layer 44 as shown in FIG. 3 that forms a thermal resistor 26 while other thin film layers described in detail below will provide electrical insulation from the substrate 22 and could provide a thermally conductive path from the thermal resistor 26 to the substrate. An electrode layer 46 as shown in FIG. 3 defines first and second electrodes 46*a*, 46*b* coupled to the resistive layer. One electrical conductor as an electrode 46*a* is shown in FIG. 2 connected to the thermal resistor 26. It should be understood that in an actual embodiment, the thermal resistor 26 and conductor or trace forming one of the electrodes 46*a* in the ink jet ejection chamber 20 would be obscured by overlying layers such as shown in FIG. 3.

Figure 5:
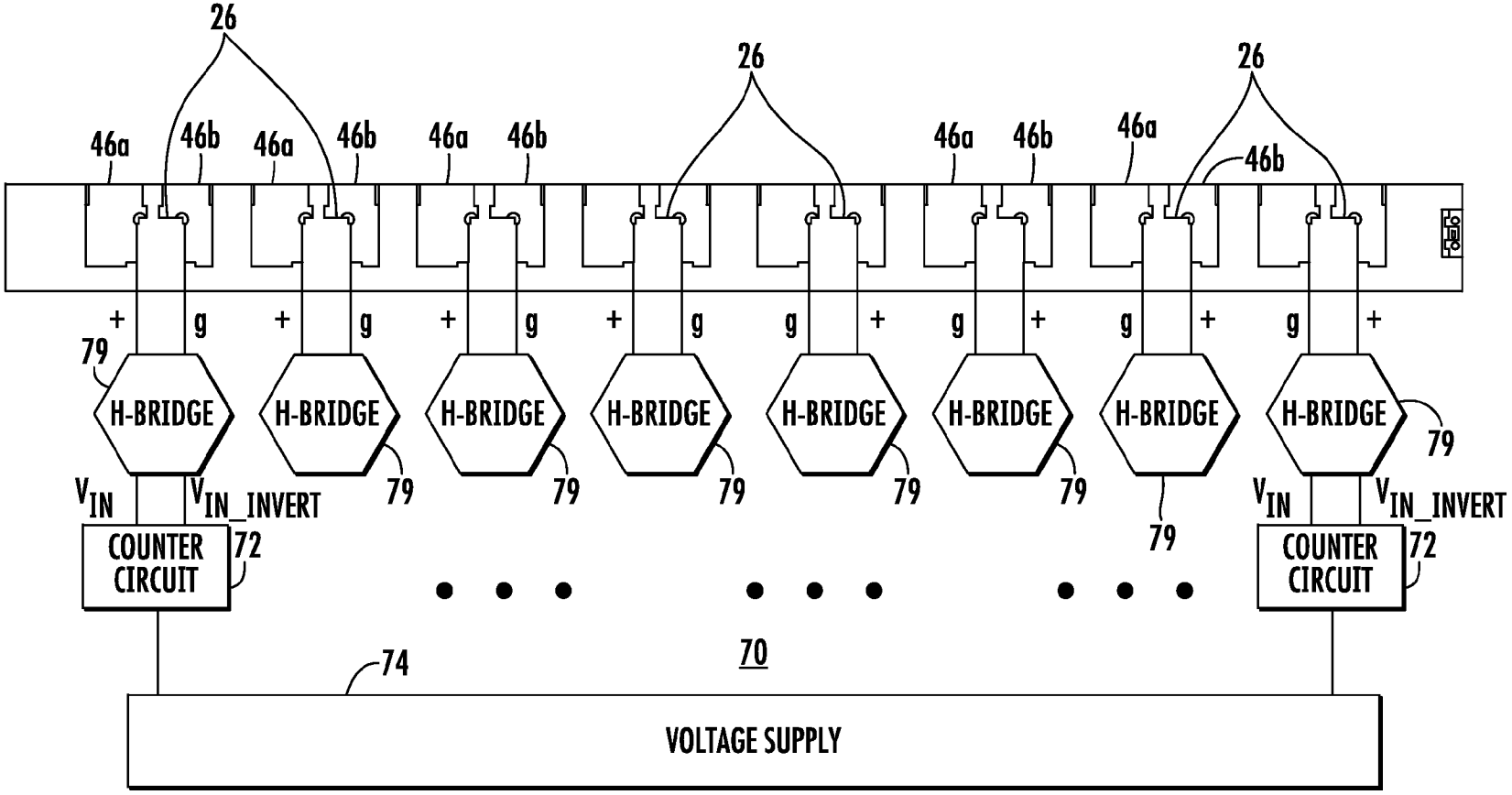
FIG. 5 is a fragmentary and partial schematic, plan view of thermal resistors used in the ink jet printhead device and showing a polarity-changing driver circuit coupled to the thermal resistors in accordance with a non-limiting example.

Ink feed holes 30 are formed through the various thin film layers 24. There may be one large hole or a group of smaller multiple holes per ink jet chamber 20. A nozzle layer 32 provides a common ink channel for a row of ink ejection chambers 20 that supply ink, which is heated by a row of thermal resistors 26 such as shown in FIG. 5 and described in greater detail below. This nozzle layer 32 is deposited over the surface of the thin film layers 24 and etched to form the ink ejection chambers 20 with one respective ink jet chamber 20 associated per thermal resistor 26. The nozzles 14 are formed in the nozzle layer 32 using conventional photolithographic techniques. Other options include mechanical or laser drilling. In this example, the silicon substrate 22 is etched to form an ink supply trench 34 that extends along a length of the row of ink feed holes 30 that extend through the thin film layers 24 so that ink from an ink reservoir will pass through the ink supply trench and may enter the ink feed holes and supply ink to the respective ink ejection chambers 20.

In operation, an electrical signal is provided to the thermal resistor 26, which vaporizes ink located at the thermal resistor to form a bubble within the ink ejection chamber 20. This bubble propels an ink droplet through the associated nozzle 14 onto paper or other print medium. The ink ejection chamber 20 is then refilled with ink by capillary action in this example and the process repeats.

Many different nozzles 14 are contained in one ink jet printhead cartridge 10. In an example, the ink jet printhead 17 of the printhead cartridge 10 includes the semiconductor substrate 22 and is about one-half inch long and has multiple offset rows of nozzles. In one example two offset rows are included, each containing 150 nozzles for a total of 300 nozzles per printhead. This example printhead cartridge 10 can print at a single pass a resolution of 600 dots per inch (DPI). It should be understood that much greater print resolution is accomplished when a larger number of nozzles 14 are formed on a printhead cartridge 10.

As will be explained in greater detail below with reference to FIG. 5, each thermal resistor 26 on the silicon substrate 22 is formed at the electrode layer 46 and includes first and second electrodes 46*a*, 46*b* and a polarity-changing driver circuit 70 coupled to each thermal resistor 26 and configured to change a driving polarity between the first and second electrodes. This polarity change between first and second electrodes 46*a*, 46*b* as grounded and pulsed terminals aids in extending the lifetime of each thermal resistor 26 since less electro-migration induced voiding and cracking occurs at a grounded edge of the resistor. The median lifetime of the thermal resistors 26 will therefore increase. The circles illustrated on the resistor show fail locations during an example testing procedure for purposes of illustration.

FIG. 3 is a cross-sectional view taken along line 3-3 of FIG. 2 and showing a single ink injection chamber 20 and other structural components of a portion of the ink jet printhead 17 and showing individual thin film layers. As will be explained in greater detail below, the dielectric layers, such as formed by silicon nitride 48 and silicon carbide 50, are formed to increase the lifetime of the thermal resistors 26 by imparting compressive stress film properties to the dielectric layers, referred to as "stress tuning," and increase the compression of these dielectric layers 48, 50 relative to other layers. In one example, this "stress tuning" occurs by forming at least one of the dielectric layers 48, 50 to have a compressive stress magnitude to operate above the normally used stress values, such as greater than 340 MPa for SiN (48) and 560 MPa for SiC (50). A lower value, for example, is 200 MPa.

Also as explained in greater detail below with respect to FIG. 4, at least one of the first and second electrodes 46*a*, 46*b* may define a bevel angle with adjacent portions of the resistive layer such as to have a range of 10-90 degrees, and in another example, 45-90 degrees to increase lifetime of the thermal resistor. The dielectric layer 48 may contact the resistive layer 44 through at least openings such as shown in FIG. 2 where the thermal resistor is exposed.

FIG. 3 shows the silicon substrate 22 that is substantially thicker than the other thin film layers and 600-700 microns thick in a non-limiting example. A field oxide (Fox) layer 40 as SiO2 is formed over the silicon substrate 22 and has a thickness of 1.25 microns in a non-limiting example. This layer 40 is formed by conventional semiconductor pressing techniques. It is possible to use other layers besides the field oxide layer such as silicon oxynitride, and PSG, BPSG, and TEOS oxide as a non-limiting example. A phosphosilicate glass (PSG) layer 42 as a dielectric layer is over the field oxide layer 40 and deposited using conventional semiconductor pressing techniques. In some cases, PSG or BPSG is used instead of FOX. As an example, the PSG layer 42 is about 0.8 microns. It is possible to use a boron PSG or boron Teos layer instead of a PSG layer.

The resistive layer 44 that will form the plurality of thermal resistors 26 is above the at least one first dielectric layer as a PSG layer 42 and in an example is formed of tantalum/aluminum (TaAl) having a thickness of 0.09 microns in a non-limiting example. Other materials forming the resistive layer besides tantalum aluminum may be used. The electrode layer 46 is formed as aluminum copper (AlCu) and is deposited over the resistive layer 44 and defines first and second electrodes 46*a*, 46*b* for each resister such as shown and explained relative to FIG. 5. The electrodes 46*a*, 46*b* are coupled to the resistive layer 44 such as formed when a mask is deposited and patterned using conventional photolithographic techniques. The electrode layer 46 and resistive layer 44 may be etched to form the thermal resistors 26 using conventional semiconductor processing techniques. The etching of the resistive layer 44 and electrode layer 46 form thermal resistors 26 such as the single thermal resistor 26 shown in FIG. 2 and in this example, having a width of 20-53 microns. The electrodes 46*a*, 46*b* extend along the edges of the ink jet printhead 17 to connect to other electrical circuits such as shown in FIG. 5. Addressing circuitry and pads may be provided on the substrate 22 (or another substrate) to provide circuitry for a series of pulse trains from a polarity-changing driver circuit 70 to the thermal resistors 26 such as shown in FIG. 5, where a number of thermal resistors 26 are shown arranged in a row. It should be understood that the layout of the resistor may be bent, e.g., in a serpentine configuration.

The at least one second dielectric layer 48 is formed above the electrode layer 46 and contacts the resistive layer 44 through at least one opening. In the example shown in FIG. 3, this at least one electrode layer is formed as a silicon nitride layer 48 over the electrode layer 46 and has a thickness of 0.5 microns and provides insulation and passivation. A silicon carbide layer 50 is formed over the nitride layer and is about 0.25 microns to provide additional insulation and passivation. These dielectric layers formed by the silicon nitride and silicon carbide layers 48, 50 protect the PSG layer 42 and resistive layer 44 from the ink as it is heated. It should be understood that other dielectric layers may be used instead of silicon nitride and silicon carbide. These layers may be etched using conventional semiconductor techniques to expose portions of the electrode layer 46 for electrical contacts, ground lines and other connectors.

An optional refractory metal layer 52 of tantalum (Ta) is formed above the silicon carbide layer 50. The electrode layer 46 and various conductors, such as gold conductors, may be coupled to other transistor circuits formed on the substrate surface such as the polarity-changing driver circuit 70 as shown in FIG. 5, in which each thermal resistor 26 is connected to a H-bridge 79 circuit as shown with the NMOS circuit of FIG. 6 and explained in greater detail below. Alternatively, the polarity-changing driver circuit 70 can be formed separately from the semiconductor chip and be formed as a separate circuit.

The nozzle layer 32 is deposited such as using spun-on epoxy known as SU8 in a non-limiting example to form the nozzles 14 and ink ejection chambers 20. It is possible to use silicon that has been micro-machined and bond them. This nozzle layer 32 may be laminated or screened on in different examples. The ink ejection chambers 20 and nozzles 14 are formed through conventional semiconductor processing techniques. Ultraviolet (UV) radiation may be used to harden an upper surface of that nozzle layer 32 except where the nozzles 14 are formed. The backside of the semiconductor substrate 20 forming the wafer may be masked to expose a portion of the backside for etching. The respective silicon oxide (Fox) and PSG layers 40, 42 may be etched to complete ink feed holes 30.

Figure 4:
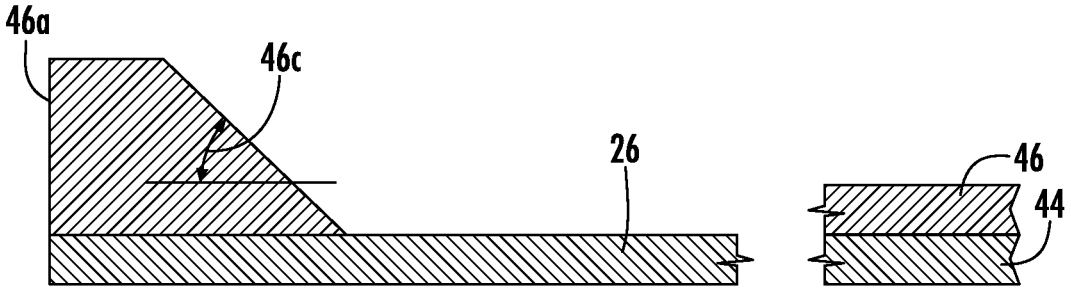
FIG. 4 is a fragmentary sectional view of the electrode layer above the resistive layer and defining a bevel angle with adjacent portions of the resistive layer in accordance with a non-limiting example.

FIG. 4 illustrates a bevel 46*a* formed at the electrode layer 46 above the resistive layer 44 such that at least one of the first and second electrodes 46*a*, 46*b* defines a bevel angle 46*c* with adjacent portions of the resistive layer 44. In one example the bevel angle 46*c* is a range of 10-90 degrees. In another example, the bevel angle 46*c* is within a range of 45-90 degrees. It has been found that the shortened bevel angle 46*c* extends the lifetime of the thermal resistor 26 because a bevel having an almost 90 degree design has been found to have predominantly a single mode of failure. As noted, it has also been found that when at least one second dielectric layer such as silicon nitride 48 and silicon carbide 50 has a compressive stress magnitude above the normal stress values as indicated before, the lifetime of the thermal resistor 26 is extended. It is possible to vary a single film stress above the normal compressive stress. The silicon nitride and silicon carbide layers 48, 50 are stress tuned as a dielectric thin film during application of the layers by varying the processing parameters. This could include varying the atomic lattice stain and varying the density of the dielectric layers, power and heat driving the processing when the layers are formed. In an example, the at least one second dielectric layer as either the silicon nitride and silicon carbide layers 48, 50 has a compressive stress magnitude of at least 340 MPa. In another example, the silicon nitride layer 48 has a compressive stress magnitude of at least 340 MPa, and the silicon carbide layer 50 has a compressive stress magnitude of at least 560 MPa.

Increased compressive stress by stress tuning of the dielectric layers 48, 50 reduces the electromigration by reducing void initiation and growth in the resistor layer. It also reduces the crack formation in the dielectric layers themselves. The polarity switching advantages are related to the charging of the SiN/SiC dielectric layers because of electron injection from negative terminals into traps of the oxide. Over time, a sheet of charge accumulates in the oxide that can discharge destructively into the substrate. Another problem is electromigration where high current densities cause metal atoms to migrate towards an anode because of the momentum imparted by the electrons moving from cathode to anode. Switching the polarity reverses the electro-migration and prevents/reduces void formation. Charging of the oxide depends on the field gradient/voltage applied and density of traps in the oxide with a higher field allowing more charges to be injected in the traps. The trap density increases with temperature of operation. During the firing process, the heat generated by the thermal resistor 26 causes thermal expansion of the layers above and below it that induces tensile stresses in the SiC/SiN dielectric layers 48, 50 on top and the dielectric layer as the PSG layer 42 on the bottom. It has been found that higher compressive stress on the dielectric layers, i.e., the SiN and SiC counters the tensile stress that can lead to cracking of the dielectric layers and hence leads to a higher median lifetime of the thermal resistors. The metallic films in turn, are also constrained from expanding by the dielectric layers 48, 50. This is a reason, for example, for suppressing void initiation and growth.

In accordance with a non-limiting example, the dielectric layers 48, 50 are made more compressive such that cracks and metal film void formation and delamination on the underlying thermal resistor 26 are limited to shorter lengths. With the more compressive stress as an initial stress applied to the dielectric layers 48, 50, the more the thermal resistor 26 and the dielectric layers themselves can withstand greater tensile stress and cracking before failure. With a shorter bevel 46*c* on the electrode 46*a* adjacent the resistor 26, e.g., closer to 90 degrees, delamination occurs less.

As shown in FIG. 5, a polarity-changing driver circuit 70 is coupled to the plurality of thermal resistors 26 and configured to change a driving plurality between the first and second electrodes 46*a*, 46*b* of each of the plurality of thermal resistors 26. A counter circuit 72 is associated with a respective thermal resistor 26 and each counter circuit 72 is connected to the voltage supply 74. The polarity-changing driver circuit 70 is configured to generate a series of pulse trains. The counter circuit 72 is configured to reverse the polarity based upon a count of the series of pulse trains working in conjunction with H-bridge circuits 76 as illustrated in detail in FIG. 6.

Figure 6:
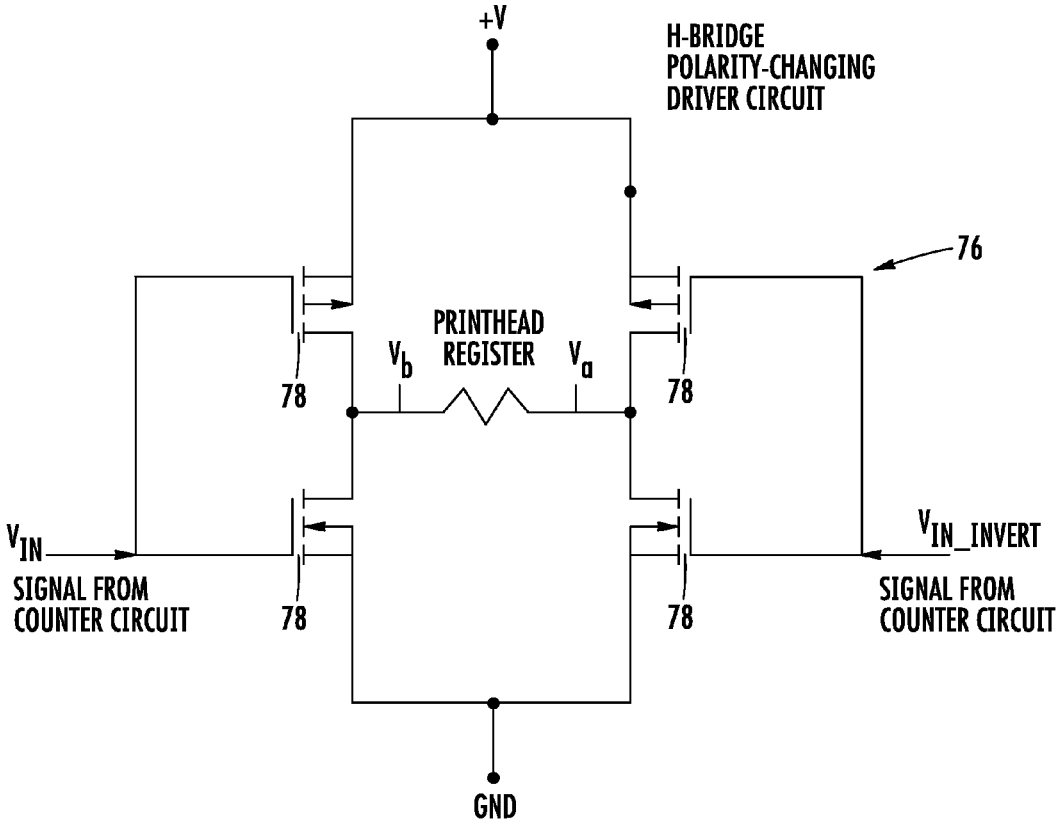
FIG. 6 is a schematic circuit diagram of a polarity-changing driver circuit in accordance with a non-limiting example.

As illustrated in FIG. 6, each H-bridge circuit 76 includes four CMOS transistors 78 that receive alternating pulses through a respective Vin signal input and the Vin_invert signal input via the counter circuit 72. The CMOS transistors 78 operate as four switches that open and close based upon the alternating signal inputs at Vin and Vin_invert from the counter circuit 72 to provide the change in driving polarity between the first and second electrodes 46*a*, 46*b* of each of the plurality of thermal resistors 26. The counter circuit 72 is configured to reverse the polarity based upon a count of the series of pulse trains into the signal inputs at Vin and Vin_invert. The polarity-changing driver circuit 70 is configured to generate the series of pulse trains in alternating polarity in one example and change the voltage polarity. As noted before, the H-bridge circuits 76 shown in FIG. 6 can be formed on the substrate or formed as separate circuits.

Figure 7:
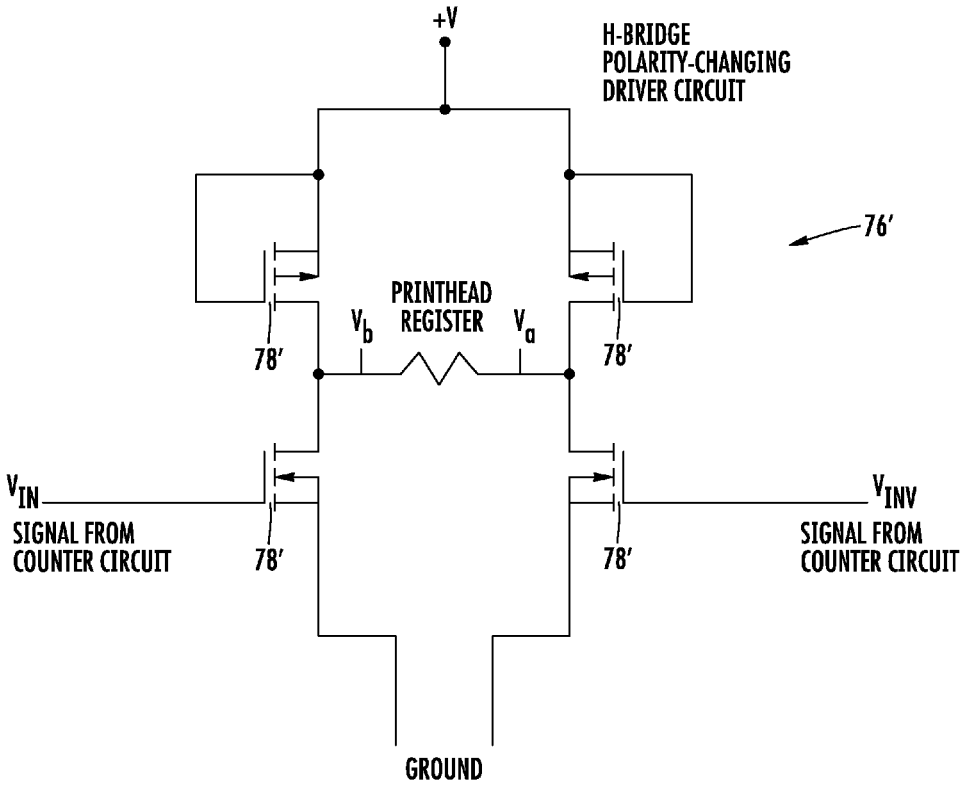
FIG. 7 is a schematic circuit diagram of another embodiment of the polarity-changing driver circuit in accordance with a non-limiting example.

FIG. 7 is another embodiment of an H-bridge circuit 76' that includes NMOS transistors 78' similar to that shown in FIG. 6 using the CMOS transistors. The NMOS transistors 78' receive alternating pulses through the respective Vin and the Vinv signal inputs from the counter circuit 72. Each NMOS transistor 78' also operates as a switch that opens and closes based upon the alternating signal inputs. A biasing circuit can make this circuit operate in a similar fashion as the circuit shown for the CMOS transistors.

Figure 8:
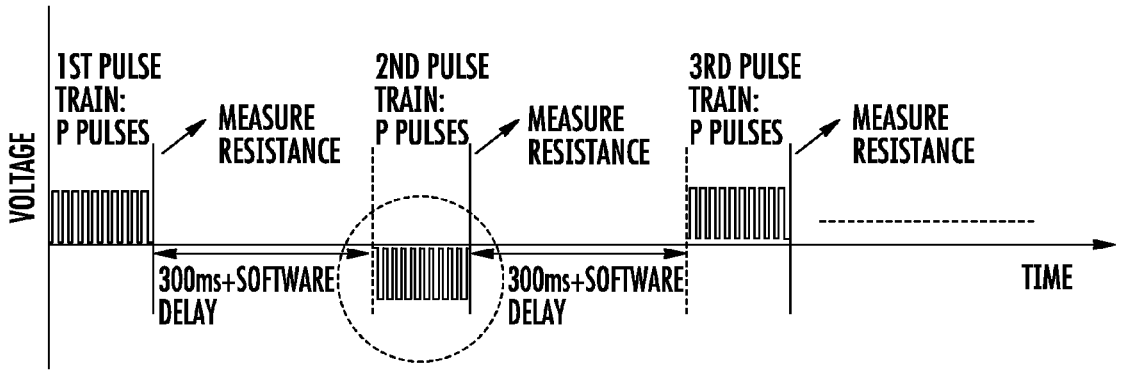
FIG. 8 is a graph showing voltage versus time for polarity switched excitation in accordance with a non-limiting example.

FIG. 8 is a graph having voltage on the vertical axis and time on the horizontal axis and showing the polarity switched excitation as a non-limiting example that was used for testing the circuit and showing the measured resistance points and showing a first pulse, second pulse and third pulse. In this example, negative voltages are obtained by switching ground and pulsed terminals. The pulses will be in bursts in a printer operation and a counter as explained above used to toggle the polarity after a certain count is reached to balance out the net charge transfer. The graph shows a test methodology and a series of pulse trains excite scribe line resistors in a test set-up such as may be shown in the circuit arrangement of FIG. 5. Resistance is measured at each end of the pulse train and a cooling period of 300 ms plus software delay between pulses simulated actual use. Tests were performed on a Keithley/TEL tester, such as manufactured by Keithley Instruments, Inc. of Cleveland, Ohio. Resistors in a scribe line were tested until the tester detects an open circuit or until the maximum pulse count was reached. Cumulative counts to fail were recorded and a maximum count was set by the test program. A 6 microjoule/pulse was used for most tests and 7.5 and 9 microjoule/pulse was used to characterize high power fail modes. The delay of 300 ms plus a software delay is not fixed. This was used to approximate idle times in actual use. The firmware of a printer will keep track of pulses and ensure that on the average of the number of pulses with one polarity is the same as these with an opposite polarity. The delay times are flexible and are used in an example testing scenario and they can be arbitrarily modified by the OEM.

FIGS. 9A-9C are examples of process stress skews. The high/low stress refers to dielectric stress, such as for the silicon nitride layer 48 and silicon carbide layer 50 and a tantalum layer 52 stress is varied in the opposite direction. In some applications there is no tantalum layer 52 on top of a resistance layer 44. For the table shown in the first and second samples of FIGS. 9A and 9B, it is measured on 2× dielectric film thickness. Table 9C as a third sample and shows measurements on an actual dielectric layer thickness and the tantalum layer film is a normal stress for the third sample. The stress in E2 corresponds to $10^2$ MPa.

The stresses in the di-electric films can be tailored by a variety of methods. In a typical deposition system, a chamber with two excitation electrodes is used. A top high frequency electrode (HF) is used to increase the ion species concentration. A bottom low frequency (LF) electrode, on which the wafer rests, is used to set the energy of the species that impinge on the wafer and deposit the film. A higher LF power would deposit a film that has a higher compressive stress due to closer packing of the atoms into the film. Another parameter that can be used to adjust the stress is the deposition pressure. A lower deposition pressure will allow more ordered film growth that has a tighter packing of the atoms resulting in a more compressive stress. The deposition rate at a lower pressure will be slower, hence a longer deposition duration will be needed for obtaining a given film thickness. In our approach we have chosen to vary only the pressure (to minimize the time needed to optimize both LF power and pressure), but it is possible to vary both the pressure and LF power simultaneously. An example of the process conditions used is shown in the table. It can be seen that the stress is inversely related to the deposition pressure for the films used.

This application is related to copending patent application entitled, "INK JET PRINTHEAD DEVICE WITH COMPRESSIVE STRESSED DIELECTRIC LAYER," U.S. patent application Ser. No. 13/893,482 filed May 14, 2013, the disclosure which is hereby incorporated by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An ink jet printhead device comprising:

a substrate;

a plurality of thermal resistors on said substrate, each thermal resistor comprising first and second electrodes and a resistive layer extending therebetween; and a polarity-changing driver coupled to said plurality of thermal resistors and configured to change a driving polarity between the first and second electrodes of each of said plurality of thermal resistors, wherein said polarity-changing driver is configured to change a voltage polarity so that said first electrode is at a voltage reference at a first polarity and said second electrode is at the voltage reference in a second polarity.

2. The ink jet printhead device according to claim 1 wherein said polarity-changing driver is configured to periodically reverse a driving voltage polarity.

3. The ink jet printhead device according to claim 1 wherein said polarity-changing driver is configured to generate a series of pulse trains.

4. The ink jet printhead device according to claim 3 wherein said polarity-changing driver comprises a counter configured to reverse the polarity based upon a count of the series of pulse trains.

5. The ink jet printhead device according to claim 3 wherein said polarity-changing driver is configured to generate the series of pulse trains in alternating polarity.

6. The ink jet printhead device according to claim 1 wherein said polarity-changing driver comprises an H-bridge.

7. The ink jet printhead device according to claim 6 wherein said H-bridge is on said substrate.

8. The ink jet printhead device according to claim 1 wherein each of said first and second electrodes comprises at least one of copper and aluminum.

9. The ink jet printhead device according to claim 1 wherein said resistive layer comprises at least one of tantalum and aluminum.

10. The ink jet printhead device according to claim 1, wherein said polarity-changing driver is configured to change a positive driving voltage polarity.

* * * * *